US010780463B1

(12) United States Patent
Lukin

(10) Patent No.: US 10,780,463 B1
(45) Date of Patent: Sep. 22, 2020

(54) MULTIPHASE LIQUID CLEANING SYSTEM

(71) Applicant: Mark Lukin, Miami, FL (US)

(72) Inventor: Mark Lukin, Miami, FL (US)

( * ) Notice: Subject to any disclaimer, the term of this patent is extended or adjusted under 35 U.S.C. 154(b) by 261 days.

(21) Appl. No.: 15/910,002

(22) Filed: Mar. 1, 2018

Related U.S. Application Data

(60) Provisional application No. 62/465,297, filed on Mar. 1, 2017.

(51) Int. Cl.
*B08B 3/14* (2006.01)
*B08B 3/02* (2006.01)
*B08B 3/10* (2006.01)

(52) U.S. Cl.
CPC ..... *B08B 3/14* (2013.01); *B08B 3/02* (2013.01); *B08B 3/106* (2013.01); *B08B 2203/007* (2013.01); *B08B 2203/027* (2013.01)

(58) Field of Classification Search
CPC .. B08B 3/14; B08B 3/02; B08B 3/106; B08B 2203/007; B08B 2203/027; E01H 1/103
USPC ..... 134/108
See application file for complete search history.

(56) References Cited

U.S. PATENT DOCUMENTS 4,151,627 A * 5/1979 Wisdom ..... A47L 11/34 15/321
2005/0210620 A1* 9/2005 VanOrden ..... A47L 7/0009 15/319
2011/0131752 A1* 6/2011 Place ..... E01H 1/103 15/320

* cited by examiner

*Primary Examiner* — Michael E Barr
*Assistant Examiner* — Tinsae B Ayalew
(74) *Attorney, Agent, or Firm* — Diana Mederos; Steve Schlackman

(57) ABSTRACT

A cleaning system and wherein one or more surface cleaning devices use high-pressure, high-temperature water from a pressure module for surface cleaning, and wherein the waste water resulting from the surface cleaning is recovered, and wherein the solid waste matter within the waste water is filtered and separated into solid waste matter and clean filtered water, wherein the filtered water is reused by the cleaning apparatus and the solid waste matter is available in a form that can be disposed of by traditional means.

5 Claims, 6 Drawing Sheets

MULTIPHASE LIQUID CLEANING SYSTEM

CROSS REFERENCE TO RELATED APPLICATION

This application claims priority to U.S. provisional application No. 62/465,297, entitled "Compact Mobile High Pressure, High Temperature Industrial Surface Cleaning Apparatus with Point of Contact Vacuum Recovery and Filtration and Wash Water Reuse," filed on Mar. 1, 2017, the contents of which are incorporated herein in its entirety.

FIELD OF THE DISCLOSURE

The present disclosure relates to methods and apparatuses for large-scale industrial cleaning systems utilizing at least one fluid. More specifically, the present disclosure presents a multiphase looped water cleaning cycle system and methods of use thereof.

BACKGROUND OF THE DISCLOSURE

Objects, such as buildings, concrete surfaces, tile or other structural and aesthetic surfaces are usually cleaned with power washing equipment, which use a high-pressure water spray to remove various types of dirt, such as mold, grime, dust, mud from various surfaces. The most common pressure washer consists of a motor that drives a high-pressure water pump, which is connected to a pressurized hose, which in turn is connected to a surface cleaning unit, which sprays pressurized water.

The Steel Structures Painting Council (SSPC) defines the amount of pressure used for power washing cleaning operations as the following: Low-pressure water cleaning (LP WC) uses water pressure less than 5,000 psi (34 MPa); High-pressure water cleaning (HP WC) uses water pressure between 5,000 and 10,000 psi (34 to 70 MPa); High-pressure water jetting (HP WJ) uses water pressure between 10,000 and 25,000 psi (70 and 170 MPa); Ultrahigh-pressure water jetting uses pressures above 25,000 psi (170 MPa).

An assortment of nozzles can be attached to the surface cleaner, depending upon the application. The nozzle affects both the shape of the water output as well as the water pressure. However, the higher the flow rate or wider the water dispersal, the lower the output pressure.

Large industrial or public spaces with large surface areas of hard material, such as concrete, use pressure at 5000 PSI or above to remove oil and dirt that may have been accumulating for years while at the same time, that pressure must cover a wide enough dispersal zone to minimize the man-hours necessary to clean a facility.

Additionally, most cleaning machines only provide faucet temperature water, however, high temperature water allows for better cleaning at lower pressure. A pressure pump also needs an adequate water supply to function properly. The pump cannot draw more water from the source to which it is connected than that source can provide, so connecting a high-pressure pump to a traditional outdoor faucet would be inadequate. Thus, a pressurized cleaning machines often need a large water truck with a tank containing enough water for the cleaning machine to disperse the high volumes of water required. These trucks can be filled prior to cleaning, however, in many cases, the high volume of water being dispersed over a cleaning shift may require multiple water trucks.

An additional impediment is the water truck's size, as it is often too large to fit in a cleaning area, such as an indoor garage with low ceilings, resulting in a need for the cleaning crew to be far away from the cleaning machine, making it difficult to monitor the unit without additional personnel.

Even more problematic are the requirements for waste water disposal. Allowing the waste water to run off into sewer systems or storm drains is prohibited in most areas due to environmental regulation since the waste water contains hazardous materials that could be harmful, especially if they leach into the water table.

Instead the waste water must be collected and brought to a water treatment facility for disposal. The typical cleaning setup uses berms to trap the water and an additional water pump to pump the water into secondary water truck, which can transport the water to the water treatment or other approved disposal facility.

Additionally, transporting waste water through populated neighborhoods often requires permits, all of which dramatically increases the time, complexity, and manpower needed to clean these spaces.

SUMMARY OF THE DISCLOSURE

What is needed is an environmentally-friendly, compact, pressurized surface cleaning apparatus that can supply high temperature water to one or more pressurized surface cleaners, each surface cleaning capable of dispersing hot, high-pressure water over a wide area, and where the waste water can be recovered and quickly filtered a the point of contact, such that the solid or viscous waste is separated from the water wherein the waste material can be disposed of using traditional methods, and the filtered water can be recycled back into the surface cleaning apparatus for continued use.

The present disclosure detailed herein describes a compact, surface cleaning apparatus capable of supplying one or more high-pressure surface cleaning devices with high-temperature water, and wherein the cleaning apparatus includes vacuum recovery to collect the waste water produced by the surface cleaners, filters the waste water wherein the clean water can be recycled back into the cleaning apparatus and providing the filtered waste material in a form that allows for easy disposal by traditional means.

The present disclosure utilizes a multiphase looped water cleaning cycle wherein the phases include, but are not limited to cleaning, water filtration, water recovery, and waste disposal.

A vacuum blower attached to a vacuum tank pressurizes the multiphase looped water cleaning cycle wherein water can be pumped through multiphase looped water system of the cleaning apparatus.

Clean water or liquid is added to a water filtration tank and is pumped from the water filtration tank into one or more burners wherein the water is heated to a user defined temperature. While heated water is recommended, it is not required. The liquid is pumped from the burners into one or more surface cleaners that shoot high-pressure water against a surface to remove dirt and debris.

In the filtering phase, waste water or liquid resulting from the cleaning phase is recovered from the cleaning area and pumped through a multistage filtering system. The waste water or liquid is pumped into a vacuum tank where large particulate matter is removed. The remaining waste water or liquid is pumped out of the vacuum tank and into a water filtration tank.

In some embodiments, bag filters remove sand, dirt and other small debris from the waste water. The water is pumped from the bag filters into a chambered filtering area wherein various types of water filtration filtered materials can be inserted to remove oils and grease, smaller particulates, and suspended particles from the waste water. The materials can be used in multiple combinations and configurations so as to adjust to the particular cleaning requirements. Polishing filters then remove small (usually microscopic) particulate material, or dissolved material from water.

The resulting clean water is pumped back into the burners to continue the multiphase looped water cleaning cycle. Once the cleaning session is complete, the remaining water can be pumped into the water filtration tank, and the cleaning apparatus powered down. The water is drained from the water tank by removing the water cap located at the bottom of the water tank. The remaining water deposited within the water filtration tank is clean and does not need to be deposited into a specialized facility. It can be drained into the surrounding environment without negative environmental impact. The filtered material can be disposed of through traditional means. The current invention contemplates both disposable filters and those that can be cleaned and reused.

The cleaning apparatus is modular wherein additional components can be easily added so multiple operators can work in tandem. It is designed to be mobile and compact with the ability to fit into small industrial or commercial facilities, such as parking garages or roadway tunnels. As such, this surface cleaning apparatus can fit into spaces that traditional cleaning systems cannot.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

REFERENCE NUMERALS OF THE DRAWINGS

Figure 1:
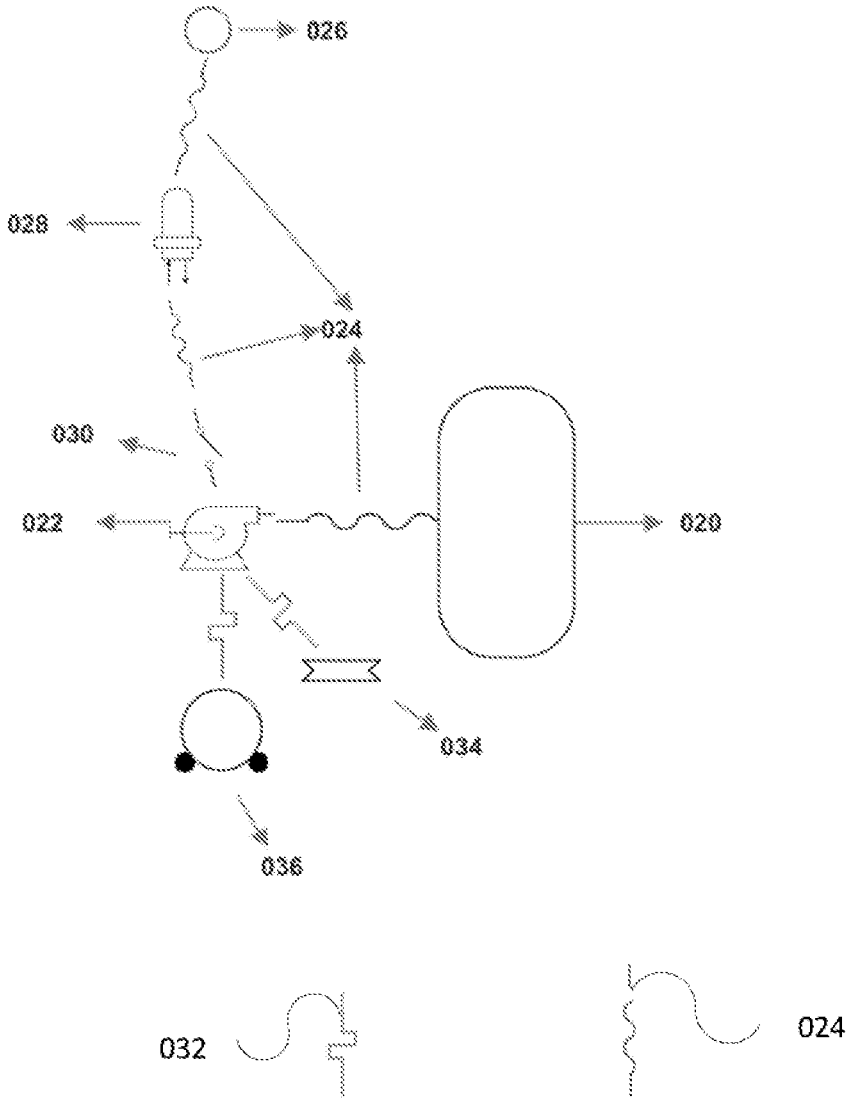
FIG. 1 shows a schematic of an exemplary cleaning system with power and liquid conduit channels.

The following list refers to the drawings.

Initial Water Source 020
Water Pump 022
Liquid Conduit 024
Surface Cleaning Unit 026
Water Heater 028
Flow Control Switch 030
Power Conduit 032
Pressure Control Dial 034
Throttle Control 036
Positive Displacement Blower 038
Vacuum Tank 040
Vacuum Tank Rear Face 042
Air Conduit 044
Vacuum Tank Air Outlet 046
Air Muffler 048
Inlet Ports 050
Waste Water Outlet Port 052
Vacuum Tank Waste Water Outlet Pump 081
A Baffle 056
Baffle Lower Floor 058
Baffle Lower Floor Outside Edge 060
Baffle Wall 062
Baffle Wall Outer Edges 064
Baffle Top 065
Maximum Water Fill Line 066
Primary Water Sensor 068
Secondary Water Sensor 070
Tertiary Water sensor 072
Inlet Pipe 074
Debris Screen 076
Pressure relief valve 078
Water Filtration Tank 080
Pre Filter 082
Waste water conduit 083
Filtration Chambers 084
Initial Chamber 084A
Central Chambers 084B-084J
Final Chamber 084*k*
Polishing Filters 086
Filtration Passage 087
Polishing Filter Canisters 086A-C
Pre Filter Bypass Valve 088
Chamber Filters Media 085
Water Tank Pump out 093
Water Tank Drainage Hole 096
Power Supply System 098
Control Panel 099
Boiler System 100
Circulating Pump System 102
Pressure Pump System 104
Filtration System 106
Liquid Loop Outlet 107
Filtration Tank 110
Balancing Pump 112
Supply Pump 114
Vacuum Pump-out 116
Control Valve 118
Liquid Deposition Outlet 120
Liquid Vacuum Inlet 122
Cleaning Attachment 124
Mount System 126
Liquid Level Sensor 128

DETAILED DESCRIPTION

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

Referring now to FIG. 1, a schematic of an exemplary system is shown. More specifically, a pressure module schematic is shown. The system requires an initial water source. In an exemplary embodiment, the water filtration tank acts as both the initial water source as well as the filtration system however, additional non-filtration water sources and containers, such as additional water tanks or fire hydrants may be used for the initial water source or as additional water sources to supplement the water supply. The initial volume of water required is variable based on a host of considerations, such as the pressure required for cleaning, the amount of waste water than can be reclaimed, evaporation, and the desired operational time period.

In an exemplary embodiment, an operator adds water to the Water Filtration Tank to be used as the Initial Water Source. The Initial Water Source 020 is pumped to one or more Surface Cleaners via the Pressure Module. A Water Pump 022 pumps the Initial Water Source 020 through one or more Water Conduits 024 to one or more Surface Cleaning Units 026. The Water Pump 022 specifications are dependent upon several factors including the desired pressure in pounds per square inch (PSI), which dictates the force available to remove dirt, oil and debris from a surface; the flow rate in gallons per minute (GPM), which determines the energy available to lift particles and debris; for a desired action such as cleaning, paint stripping or cutting. Other factors include the surface type and condition, and the nozzle orifice size and shape of the Surface Cleaning Unit, which can be used to increase or decrease the flow rate and pressure as well as safety consideration for the operator.

For heavy-duty professional grade uses such as cleaning of industrial surfaces, paint stripping, graffiti removal, stubborn stains, or mold and mildew removal, it is recommended that the water pump be between 3000 and 4000 PSI and have a flow rate of 4 or more GPM.

One embodiment uses a variable speed induction plunger pump, which provides continuous output, however, other water pump sizes and types are contemplated. One embodiment uses a Annovi-Reverberi Triplex Plunger Pump which produces 3650 PSI at 8 GPM Powered by a Kohler Command Pro CH-752 27 Horsepower V-Twin Gasoline Engine with a 42 Gallon All Aluminum Gasoline Fuel Cell and a DC to AC Power inverter.

To add additional cleaning efficiency, the current embodiment provides a mechanism for heating the water before pumping it to the Surface Cleaning Unit 026. Hot water softens congealed oil and grease and significantly improves emulsification, making it easier to remove. Although various types of water heaters are contemplated, the preferred Water Heater 028 does not include a water tank, and wherein the water is heated on-demand.

On-demand water heaters will heat water only when the need for hot water arises. The common types generate hot water using diesel, propane, kerosene, electricity, or natural gas.

The Water Heater 028 raise the temperature of incoming water as it comes into the heat chamber. Initially, the increased heat is added to the ambient temperature of the water, increasing as the water flows continuously through the heating chamber as part of the Multiphase Looped Water Cleaning Cycle.

For safety, it is recommended that the Water Heater 028 not engage when the water within it is sitting idle. The heating element should only be applied during the cleaning cycle when the Surface Cleaning Unit is engaged and water is flowing through the system. The Water Heater 028 can be automatically engaged or shut down through the use of a Flow Control Switch 030, which activates or deactivates the Water Heater 028 when the differential pressure within the unit rises.

Additionally, a pressure unloader valve (not shown) may be included which diverts water flow into bypass when the Surface Cleaning Unit 026 is disengaged. The pressure unloader valve may be designed to respond to either an increase in pressure or a change in flow, although other types are contemplated. The current embodiment uses a Beckett Pro-101 Oil Burner Assembly, Diesel Unit as the Water Heater 028.

Additionally, the present invention includes a Pressure Control Dial 034, which allows a user to regulate the water pressure produced by the Water Pump 022 for various types of surfaces and conditions, such as cleaning a surface with loose mortar vs. paint stripping on a metal surface.

A Power Supply 036 provides power to the Water Pump 022. The present embodiment uses a Kohler Command Pro CH-752 27HP V-Twin Gasoline Engine, although other types of power supplies are contemplated.

A Throttle Control 036 automatically regulate the power supplied to the Water Pump 022 by increasing or decreasing the engine throttle, determined by the desired output of the Surface Cleaning Unit 026. Multiple types of surface cleaning units are contemplated. However, for the filtration to occur and for environmental concerns, the dirty water resulting from the cleaning process should be recovered.

Figure 2:
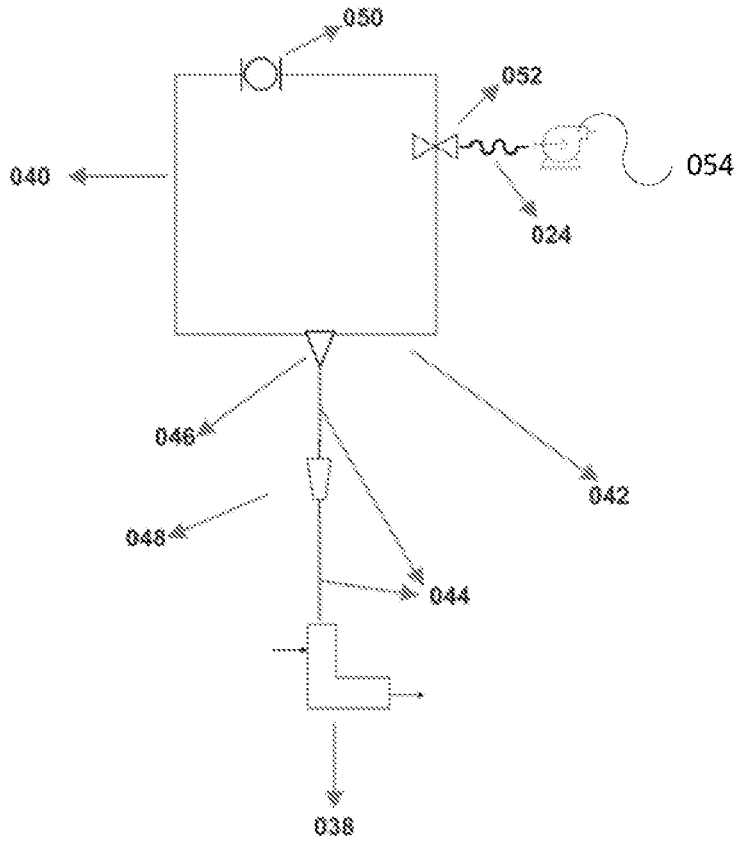
FIG. 2 shows a schematic of an exemplary vacuum tank and power and liquid conduit channels.

Referring now to FIG. 2, a schematic of an exemplary system is shown. Vacuum pressure facilitates water recovery. Vacuum pressure is created using a tri-lobe Positive Displacement Blower 038. While the present invention contemplates multiple types of blowers or compressors to create a vacuum, the current embodiment uses a tri-lobe positive displacement blower due to its reliability, quiet operation, performance efficiency, and compact design. One embodiment uses a Gardner Denver TriFlow Ti410, which delivers vacuum to 16" Hg and Flows to 700 cfm (open flow).

The Positive Displacement Blower 038 connects to a Vacuum Tank 040. The Vacuum Tank 040 construction materials and structural strength are determined by the maximum negative pressure that can be created within the Vacuum Tank 040 by the Positive Displacement Blower 038.

Cylindrical or spherical pressure tanks are common because the symmetry of the shape provides relatively equal stress in all directions tangent to the surface of the vessel. However, these vessel shapes along with vacuum pressure and water outlet provide the elements from which a liquid vortex is created while conserving angular momentum. The formation of vortices can entrain vapor in the liquid stream, leading to poor separation of water from the debris in the waste water, cause cavitation in the water outlet pumps or allow water vapor or water laden debris to enter the air outlet.

Additionally, the preferred embodiment includes a multiple outlet and inlet ports, wherein connection points may require flat surfaces. Spherical or cylindrical vacuum tanks with a multiple of flat facets can reduce strength and structural stability of the vacuum tank or increase construction costs.

Therefore, the present invention uses a non-spherical or non-cylindrical Vacuum Tank 040 to minimize the potential for vortices and provides a multifaceted surface with which to attach a multiple of outlet and inlet ports, valves, sensors or other attachments.

The current embodiment utilizes a cuboid shaped Vacuum Tank 040 wherein the attachments are flush to one or more of the inside and outside surface areas, although other multifaceted shapes such as hexagons or decagons are contemplated.

An exemplary compact and portable embodiment uses a 20" wide×20" deep×30" high Vacuum Tank 040 constructed from ¼" Aircraft Aluminum. In the cuboid embodiment, the Positive Displacement Blower 038 is connected to the Vacuum Tank Rear Face 042 by Air Conduit 044 at Vacuum Tank Air Outlet 046.

The diameter of the Air Conduit 044 is determined by the manufacturer specification of the Positive Displacement Blower 038, which in the present embodiment is 4 inches. In a preferred embodiment, Air Conduit 044 includes an Air Muffler 048 to reduce noise. One embodiment may use a Magnaflow 12773 Satin Stainless Steel 7-Inch Round Muffler.

Waste material enters Vacuum Tank 040 through one or more Inlet Ports 050. An inlet port may be a valve such as a gate valve to regulate air flow. Waste water is pumped out of the Vacuum Tank 040 through the Waste Water Outlet Port 052, by Vacuum Tank Waste Water Outlet Pump 081.

Figure 3B:
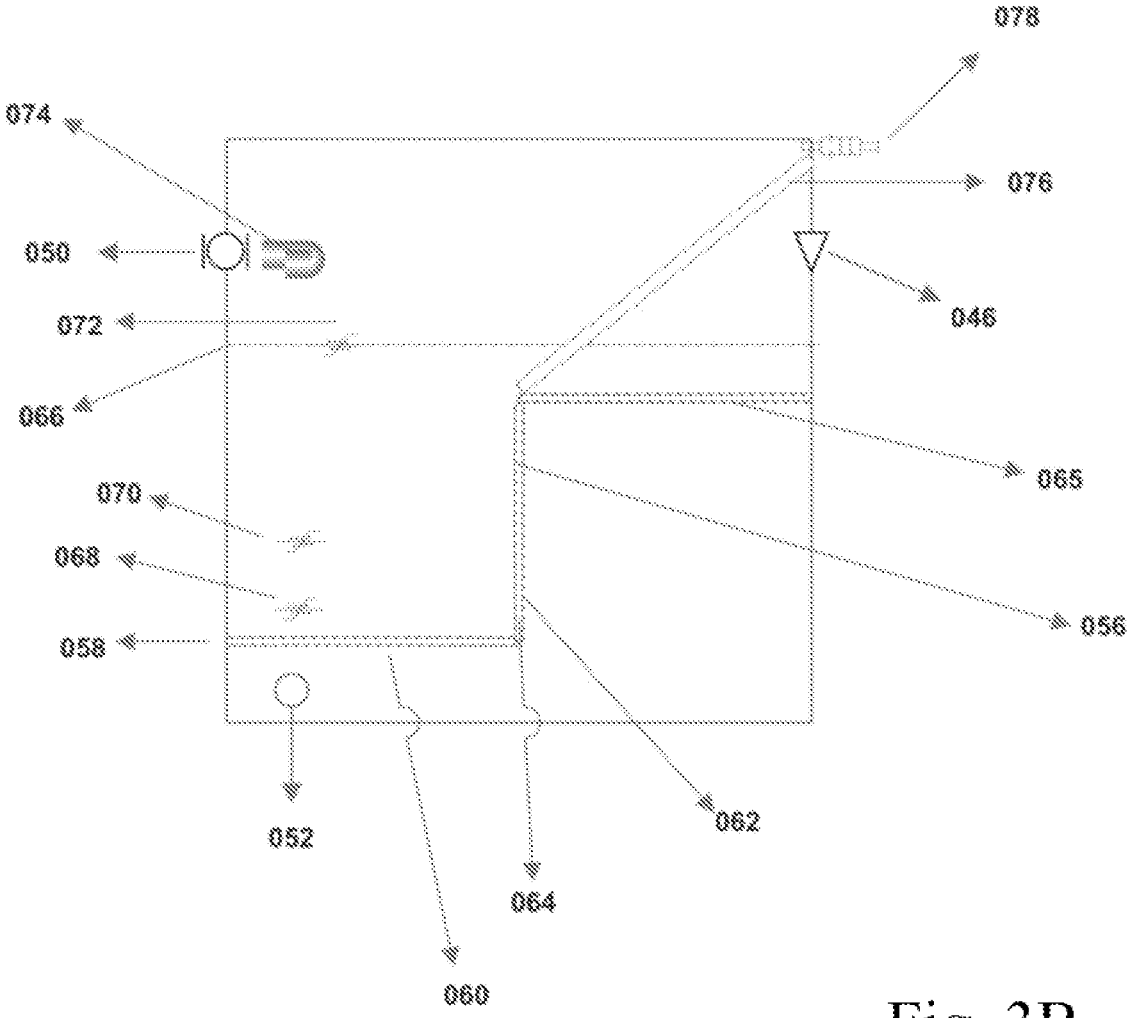
FIGS. 3A and 3B show an interior side view of an exemplary vacuum tank with baffle.
Figure 3A:
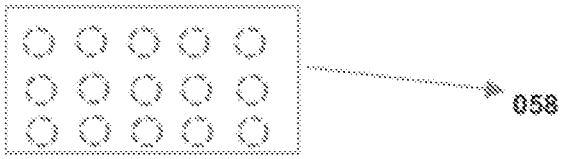

Referring now to FIGS. 3A and 3B, an exemplary vacuum tank is shown. It is preferred that the Waste Water Outlet Port 052 be located on a side of the Vacuum Tank 040 at a position near the bottom to both remove waste water and the ensure that the Waste Water Outlet Port 052 remains submerged so that the Vacuum Tank Waste Water Outlet Pump 081 does not run dry, although any location within the tank is contemplated.

However, negative pressure created within the Vacuum Tank 040 by the Positive Displacement Blower 038, may cause the waste water within the Vacuum Tank 040 to rise above the floor, creating the potential for the Waste Water Outlet Port 052 to be exposed to air as well as the Vacuum Tank Air Outlet 046 to be exposed to water.

In an exemplary embodiment, a Baffle 056 which reduces the volume of waste water directly adjacent to the Water Outlet Port 052, reducing the impact of negative pressure so that Water Outlet Port 052 remain submerged when the Vacuum Tank 040 is in use. In some embodiments, a baffle system may comprise a baffle 056, a Baffle Lower Floor 058, and a Baffle Floor Outside Edge 060.

In an exemplary embodiment, the Baffle 056 has a Baffle Lower Floor 058 which is placed parallel or at an angle to the floor of the Vacuum Tank 040 and wherein a majority of Baffle Lower Floor Outside Edge 060 are in close contact to two or more walls of the Vacuum Tank 040 and wherein one or more Baffle Lower Floor Outer Edge 060 makes close contact to a side of Vacuum Tank 40 that contains one or more Water Outlet Ports 052, at a point above the Water Outlet Ports 052. It is preferred that the Waste Water Outlet Port 052 be located on a side of the Vacuum Tank 040 at a position near the bottom, below the Baffle Lower Floor 058

A Baffle Wall 062 connects to the Baffle Lower Floor 058 at an angle of between 45 and 135 degrees, on a vertical plane, wherein one or more Baffle Wall Outside Edges 064 are in close contact with two or more sides of Vacuum Tank 040. A Baffle Top 066 is connected to one or more Baffle Wall Outside Edges 064 at an angle of between 45 and 135 degrees, on a horizontal plane in close contact with two or more walls of the Vacuum tank and wherein the majority of its area is not located above the Baffle Lower Floor 058.

In a preferred embodiment, as seen in FIG. 3A, the Baffle Lower Floor 058 is perforated wherein the perforation allow water to flow below the Baffle Lower Floor 058 yet holds back large debris, acting as an initial filtration mechanism. The perforation size can be varied based upon the type of material entering the Water Tank 040.

The entire baffle is not required to be in physical contact with walls, but only reduce the volume of water to reduce negative pressure and it must be above the outlet ports and contacting at least some portion that is perforated to allow the water to go down. It is possible that the Baffle wall is also perforated.

In an exemplary embodiment, the Baffle is a single piece of aluminum, ⅛ inch thick with quarter sized round perforation located on the Baffle Lower Floor 058. The Baffle Wall is a 90 Degree angle to both the Baffle Lower Floor 058 and the Baffle Top 065.

The Baffle Lower Floor 058, the Baffle Wall 062 and the Baffle Top 065 are equal in area each being approximately 20 inches×10 inches and wherein the lower floor is located approximately 4 inches above the Vacuum Tank Floor on a parallel plane.

The Baffle 056 is held in place by its weight wherein the Baffle Spacers are attached to the Vacuum Tank Sides at 8 or more points and come into contact with the underside of the Baffle 056. Additional types of spacers are contemplated including latching mechanisms or ties.

In an exemplary embodiment, the Baffle is made from ¼ inch aluminum to provide sufficient weight to hold the Baffle 056 in place, however, other materials are contemplated such as metal alloys or plastics.

In an exemplary embodiment, water levels are managed by a Primary Water Sensor 068 and a Secondary Water Sensor 070. The Primary water sensor is set at a location above the Vacuum Tank Waste Water Outlet Pump 081. If the waste water in the Vacuum Tank 040 falls below the Primary Water Sensor 068, the Vacuum Tank Waste Water Outlet Pump 081.

Waste material enters Vacuum Tank 040 through one or more Inlet Ports 050, which in a preferred embodiment are placed above the Maximum Water Fill Line 066, wherein the Inlet Ports 050 will not be submerged. The Vacuum Tank Air Outlet 046 is also located above the Maximum Water Fill Line 066. A submerged Vacuum Tank Air Outlet 046 will reduce the available vacuum pressure as well as potentially causing damage to the Positive Displacement Blower 038. A submerged Inlet Ports 050 will remove the Surface Cleaning Unit from the vacuum effect In an exemplary embodiment, a Tertiary Water Sensor 072 is located at the Maximum Water Fill Line 066. If the waste water reaches the Maximum Water Fill Line 066, the Secondary Water Sensor 068 will be triggered shutting down the power to the Positive Displacement Blower, and therefore the Surface Cleaning Units, so that no additional waste water can enter the Vacuum Tank 040.

In an exemplary embodiment, the Inlet Ports 050 and the Vacuum Tank Air Outlet 046 are on opposite sides of the Vacuum Tank to minimize waste water entry into the Vacuum Tank Air Outlet 046. In some embodiments, the inlet ports are at the top of the tank but could be anywhere provided that they are far enough away from the outlet, which in the current configuration is on the opposite wall.

Waste water enters the tank which can generate turbulence within the Vacuum Tank 040 resulting in water vaporization and drying of debris. Drying debris is lighter than waterlogged debris and can therefore remain suspended within the turbulent air, remaining uncaptured by the initial filtration, and along with water vapor, can enter the Vacuum Tank Air Outlet 046.

To reduce the possibility of air turbulence, it is a goal of the present invention to reduce air turbulence and water cavitation by slowing down the speed of the waste material entering the Vacuum Tank 040. While other methods are contemplated, the current embodiment includes a Inlet Pipe 074 attached to the Waste Water Outlet Port 052 on the inside of the Vacuum Tank 040. Waste material entering the Vacuum Tank 040 curves through the Inlet Pipe 074 and is directed against the side of the Vacuum Tank 040. An Inlet Pipe 074 may be configured in a U, J, 90-degree, or any other curved, straight, or angled pipe.

In the preferred embodiment, the waste water material is directed to a side of the Vacuum Tank 040 above the Baffle Lower Floor 058, wherein the reduced speed waste water and debris can be filtered and removed from the Vacuum Tank through the Waste Water Outlet Port 052.

In another embodiment, two Inlet Ports 050 are attached to two Inlet Pipes 074 wherein the two Inlet Pipes 074 are directed toward the corners of the Vacuum Tank 040 above the Baffle Lower Floor 058 where the force from the velocity of two Inlet Pipes 074 for equalizing liquid flows. Other valves are contemplated such as an L-shaped valve wherein the waste material is directed down and the waste water outlet is near the Baffle Lower Floor 058.

In a preferred embodiment, the Vacuum Tank 040 has a Debris Screen 076 to block any large airborne debris from entering Vacuum Tank Air Outlet 046.

It is recommended that the Debris Screen 076 enclose the Vacuum Tank Air Outlet 046 with relation to the Inlet Ports 050 so that no waste material exiting the Inlet Ports 050 can contact the Vacuum Tank Air Outlet 046 without crossing the Debris Screen 076.

Additionally, in a preferred embodiment, the area behind the Debris Screen 076 is of a sufficient volume such that debris that may inadvertently be vacuumed by the Surface Cleaning Unit 026, such as fabric or plastic bags, cannot block the majority of airflow from the Vacuum Tank 40 into the Positive Displacement Blower 038.

In an exemplary embodiment, the Debris Screen 076 is a 20"×20" flat, perforated aluminum sheet with ¼ inch round holes wherein the Debris Screen 076 is placed at a diagonal within the Vacuum Tank 040 and wherein one edge makes contact with the side of the Vacuum Tank above the Vacuum Tank Air Outlet 046, and is on the horizontal plane and wherein the opposite edge of the Debris screen is placed adjacent to the corner of the Baffle 056 wherein the Baffle wall 062 and the Baffle Top 065 are connected, and wherein the two remaining sides make contact with the sides of the Vacuum Tank 040.

There is also a secondary Pump for the Secondary Sensor as a safety measure. As a safety feature, the preferred embodiment includes a Pressure Relief Valve 078 that automatically releases pressure within the tank.

The current embodiment uses a Pentair Truckmount Kunkle Vacuum Relief Air Valve that opens when the pressure inside the Vacuum Tank 040 reaches 16" HG of vacuum, although other types of pressure relief valves and other HG levels are contemplated.

Water exits the Vacuum Tank 040 through the Waste Water Outlet Port 052 by the Waste Water Outlet Pump 081 and pumped into the Water Filtration Tank 080. In one embodiment, the Waste Water Outlet Pump 081 is an Annovi Reverbi AR-3024N, which can pump 7.92 Gallons per Minute (GPM) at 3600 PSI.

Figure 4A:
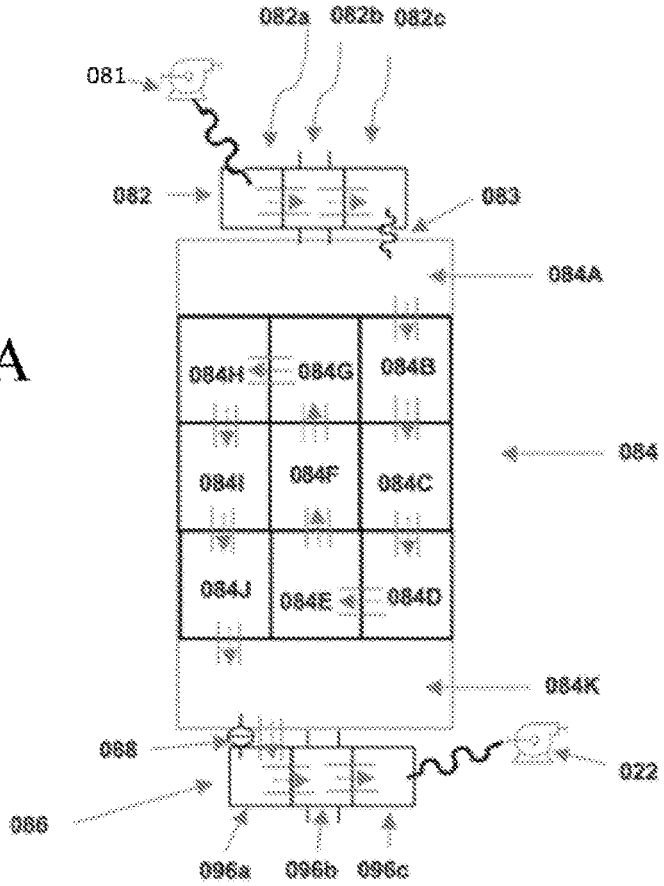
FIGS. 4A, 4B, and 4C show schematics of an exemplary water filtration tank.
Figure 4B:
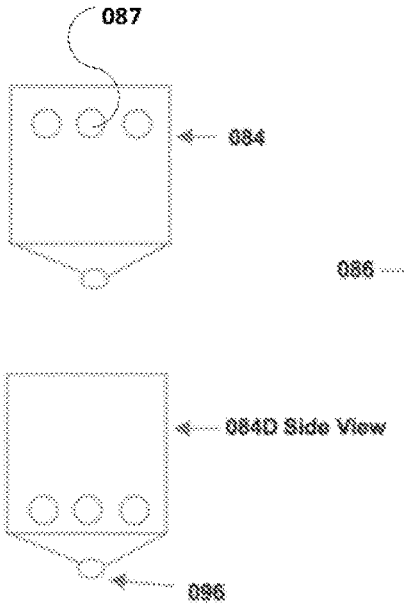
Figure 4C:
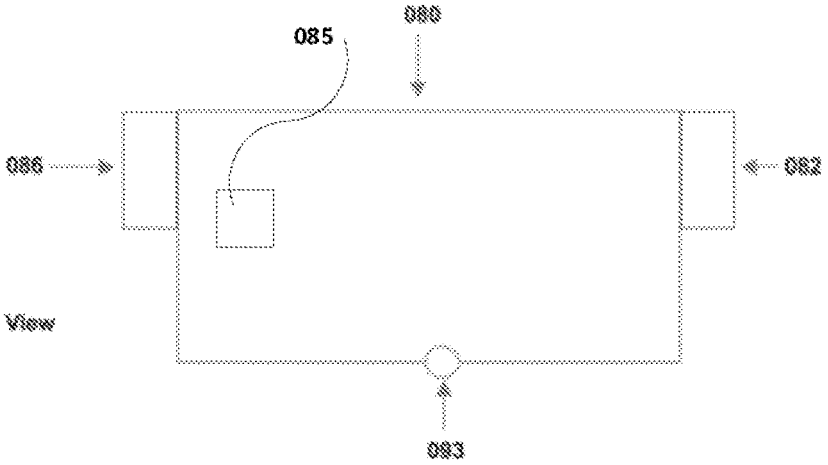

Referring now to FIGS. 4A, 4B, and 4C, schematics of an exemplary water filtration tank are shown. The Water Filtration Tank 080 comprises one or more Pre-Filters 082, one or more Filter Chambers 084 containing one or more Chamber Filter Media 085 and one or more Polishing Filters 086. Each filter stage within the Water Filtration Tank 080 removes particulates, from larger to smaller particles as water moves through the apparatus in addition to liquid waste such as oil. An exemplary embodiment uses three Pre-Filters 082, each connected in succession wherein the water exiting the Waste Water Outlet Pump 081 is pumped into the First Pre-Filter 082A, then from The First Pre-Filter 082A into the Second Pre-Filter 082B; then from the Second Pre-Filter 082B into the Third Pre-Filter 082C.

There are many types of Pre-Filters 082 that can be used to remove particulate matter from waste water; however, the preferred embodiment uses bag filters. A bag filter works through microfiltration wherein the liquid is passed through a mesh type material containing small permeable pores. Bag filters come in multiple sizes, with a multiple of pore sizes and can be used for large amounts of water. In an exemplary embodiment, the First Pre-Filter 082A is 400 microns, the Second Pre-Filter 082B is 300 microns and the Third Pre-Filter 082C is 200 microns, although other combinations, size, type and number of filters are contemplated. In an exemplary embodiment, the bag filters are placed inside Three (3) 20" Full Flow 1.5" Bag Filter Housings—PBH-420-1.5 from FilterPure.

A Pre-Filter Bypass Valve 088 allows the waste water from the Vacuum Tank 040 to bypass the Pre-Filters directly into the Filtration Chamber Tank 084, which allows an operator to remove or replace the Pre-filters 082 while the Surface Cleaning Unit is engaged.

Waste Water exits the Pre-Filter 082 through a Waste Water Conduit 083 and into the Filtration Chamber Tank 084, which can also be used as the Initial Water Source 020.

The Filtration Chamber Tank 084 is a cuboidal water-tight, 425 Gallon, all aluminum construction tank substantially similar in size to the vacuum tank and containing two or more walled interior chambers. In a preferred embodiment, the walled chambers are cuboidal with four walls, preferably of equal height, in a grid-type pattern although other chamber shapes are contemplated.

Each chamber includes a Water Flow Aperture 085 between itself and one adjacent chamber, wherein the Waste Water Outlet Pump 081 forces waste water into an Initial Chamber 084A and through the Water Flow Hole 085 into one adjacent chamber, in one direction.

The Water Flow Holes 085 alternate from an upper position to a lower position, wherein the lower position is approximately 4 inches from the bottom of the chamber and the upper position near the top of the chamber. Water must cover all the Water Flow Holes 085 in order for water to move from one chamber to another.

The Water Flow Hole 085 sizes must be large enough to allow water to flow freely between chambers, which is determined by the GPM of the water pump. If the Water Flow Holes 085 constrict the flow of water, chambers could overflow. The liquid flow from the vacuum tank to the filtration tank is preferably facilitated by gravity. This reduces power and energy requirements.

An exemplary embodiment has 11 chambers, wherein the Initial Chamber 084A is (Size) the central chambers 084B-084J are (size) and the Final Chamber 084*k* is (size).

Each chamber can include additional filter types, preferably with the ability of removing particles smaller than those removed by the Pre-Filters as well as other detritus, organic waste and liquid such as oil and other viscous material.

The alternating Filtration Passages 087 force waste water to move up or down within an adjacent chamber such that the waste water can come into contact with the filter material in a chamber. An exemplary embodiment uses either a hydrophobic or oleophilic material although other types of filter materials are contemplated. The types of filters can be varied based upon the type of material being removed from the surface or location. For example, for a location containing large amount of oil, such as a parking garage or shipyard, could fill the majority of chambers in the Filtration Chamber Tank 084 with Chamber Filter Media 085 to absorb more oil whereas an outdoor stone walkway filled with little oil and more particulate matter could fill the majority of chambers with sludge.

In an exemplary embodiment, Waste water enter the Filtration Chamber Tank 084 at the top of the tank into the Initial Chamber 084A. The 1st Water Hole 085A is located at a position approximately 4 inches above the bottom of the Filtration Chamber Tank 084 and adjacent to the Second Chamber 084B. The Filtration Chamber Tank 084 is preferably arranged with a vertical integration of a column array. Liquid passes through Filtration Passages 087 to a subsequent Filtration Chamber 084A-084K for macro filtration and settling of larger particles, detritus, sludge, dirt, sand, and silt.

Particulate matter will tend to sink due to gravitational settling, temperature fluctuations and vibration, forms of macro filtration. Adding water holes above the floor enables particulates to settle onto the bottom of the chambers whereas water holes at the bottom of the chamber would allow the force of the water to push the particulates into the adjacent chamber. The reduced forces of the water at the bottom of each chamber acts like a particulate filter.

In each chamber, particulates that did not settle have another opportunity to settle with each chamber providing another level of sludge and sediment deposition to the bottom of the filtration chambers.

Water as waste water exits the Initial Chamber 084A, the force generated by the Waste Water Outlet Pump 081 forces the waste water up the chamber and through the filter. The remaining waste water exits the Second Chamber 084B through Water Hole 085B into Third Chamber 084C.

In An exemplary embodiment, Water Hole 085C is near the top of the back wall of Third Chamber 084C which is adjacent to Fourth Chamber 085D. Waste water enters Chamber 085D and is forced downward through the Fourth Chamber 085D and into the Fifth Chamber 085E in the pattern as shown in FIG. 4A until the waste water enter the Final Chamber 085J.

Final Chamber 085J also acts as a bypass chamber when the high pressure pump is not engaged. When the system is idle, the pumps may still be active, so clean water is pumped directly into the final chamber, bypassing the earlier filtration, where it is polished again, out the polishing filters and back into this chamber until the surface cleaner or cleaning attachment is engaged.

Water Tank Pumpout 093 removes water from Final Chamber 085J, into the Polishing Filters 086. In An exemplary embodiment, the Water Tank Pumpout 093 is a ¼ HP General Purpose Laundry Tray Pump by AMT although other water pumps are contemplated.

The Polishing Filters 086 remove the remaining small or microscopic particulate material or very low concentrations of dissolved material from the waste water as a form of micro filtration. The types of polishing filter and the size of the particulates removed are variable, depending upon the type of surface being cleaned and the size of remaining particulates acceptable to the operator.

An exemplary embodiment uses three high temperature string wound cotton polishing filters cartridges inside cartridge housings, such as the TB-20-CB15-PR Clear Filter Housing for 20" Full Flow/BB Cartridges by H2O Distributors. High temperature string wound cartridges are specifically designed for the removal of dirt, rust and sediment from water. The string wound cartridges in an exemplary embodiment have stainless steel center tubes rated for temperatures up to 180° F. However, other polishing filters are contemplated including, but not limited to, pleated, reverse osmosis membranes, granular activated carbon, or specialty cartridges that remove chemical additives such as chloramine and chlorine.

In an exemplary embodiment, a filtration system may comprise Polishing Filters 086 that are placed in succession with the Polishing Filter One 094A being a 150 micron filter, Polishing Filter Two 094B, being a 100 micron filter and Polishing Filter Three 094C being a 50 micron filter.

In a preferred embodiment, Polishing Filters 086 may be enclosed in containers that are clear so the operator can visually inspect the filters to determine when each made need to be replaced. Since the Polishing Filters 086 are under pressure, An exemplary embodiment includes a bypass valve, wherein water exiting from Final Chamber 084J bypass the Polishing Filters 086, allowing the Polishing Filter Canisters 086A-C to be depressurized so that the filters can be replaced while the high pressure pump is engaged. The water exits the Polishing Filters 086 through Water Pump 022 for use by the Surface Cleaning Unit 026.

When the system is ready to be maintained, the Pre Filters 082, Polishing Filters 086 and Chamber Filter Media 085 can be discarded through traditional trash removal means, such as incineration or other conventional means of disposal.

The remaining water in the Water Filtration Tank will have particulates, oil and other matter below the levels that would require the permits or special facilities for removal. Water can be drained from the Water Filtration Tank 080 through the Water Tank Drainage Hole 096 located at the bottom of the Water Filtration Tank 080. In an exemplary embodiment, sediment deposited on the floor of the Central Chambers 084B-084J, can be removed through Water Tank Drainage Hole 096 by means such as spraying clean water from a traditional garden hose into the Central Chambers 084B-084J.

Figure 5:
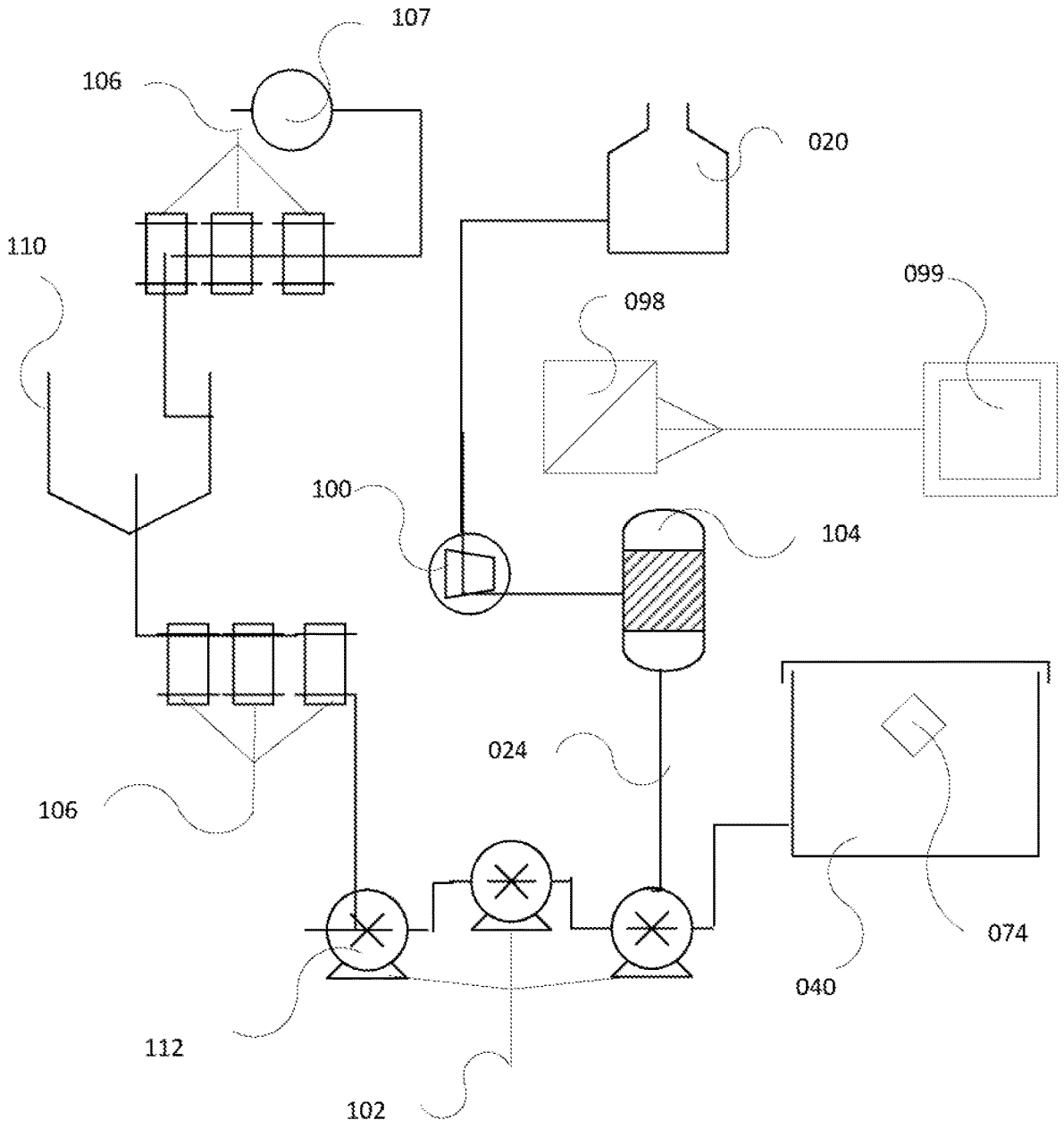
FIG. 5 shows a schematic of an exemplary system with exemplary liquid conduit pathways.

Referring now to FIG. 5, a schematic of an exemplary system with exemplary liquid conduit pathways is shown. A Liquid Conduit 024 may be a pipe or hose network that may connect all or some of the following components to create a system: a Power Supply System 098, a Water Source 020, a Boiler System 100, a Circulating Pump System 102, a Pressure Pump System 104, a Filtration System 106, a Filtration Tank 110 (shown in FIGS. 4A-4C), and a Vacuum Tank 040 (shown in FIGS. 3A and 3B). The system components are connected via Liquid Conduits 024 and Power Conduits 032. Each of the system components may comprise attachments such as sensors for sensing power inputs and outputs, and for sensing water levels and flow rates.

The Power Supply System 098 may be an engine, electric, electronic, chemical, semi conductive, nuclear, solar, magnetic, hydraulic, or hydrostatic powered. The Power Supply System 098 may have one or more repetitive components such as three engines coupled to ion batteries. The system may also be powered by plugging the system containing electrical circuitry into an electrical outlet. The Power Supply System 098 may be coupled to a Control Panel 099. The Control Panel 099 may comprise electrical breakers and connections to a central connection unit. The Control Panel 099 may comprise a logic circuit couple to computer software executable on a processor and stored on a server and displayed on a monitor.

The Boiler System 100 is also demonstrated as an alternative and exemplary embodiment in FIG. 1. The Boiler System 100 may comprise at least one apparatus capable of heating the liquid if desired.

The Circulating Pump System 102 comprises at least one circulating pump. Exemplary pumps may be a balancing pump 112, a supply pump 114, and a vacuum pump-out 116. The pumps may be situated between the Vacuum Tank 040 with the Inlet Pipe 074 and the Filtration Tank 110. The Circulating Pump System 102 facilitated the movement and regulation of liquid flow between the Vacuum Tank 040 and the Filtration Tank 110. The pumps may be arranged in any order and may be connected to any tank. In some embodiments, pumps may be implemented with sensors and valves to regulate or modulate liquid flows and balances. In some embodiments, a single pump may be used, or a plurality of pumps may be used in a Circulating Pump System 102. The pumps comprise at least one inlet and one outlet to allow the liquid to be pumped.

The Pressure Pump System 104 may receive and pressurize liquid from an Initial Water Source or Liquid Source 020 or recycled liquid that has been processed by the system. For example, after the filtration phase, the liquid may return via a Liquid Conduit 024 to the Pressure Pump System 104. The liquid flows through a pressure pump capable of pressurizing the liquid to a desired level. The pressurized liquid may or may not be subsequently heated.

The Filtration System 106 may comprise a single or a plurality of filters (see FIG. 4C). The system may comprise one or more filtration phases. A Filtration System may have a phase prior to the liquid entering the Filtration Tank 040 (See FIG. 4A) or after entering the Filtration Tank 040 or both. The Filtration System facilitates micro filtration of microscopic particles. Filters may be cellulose, charged, chemically treated, structured gills, or bags, or may also include ultraviolet treatment of the liquid.

Figure 6:
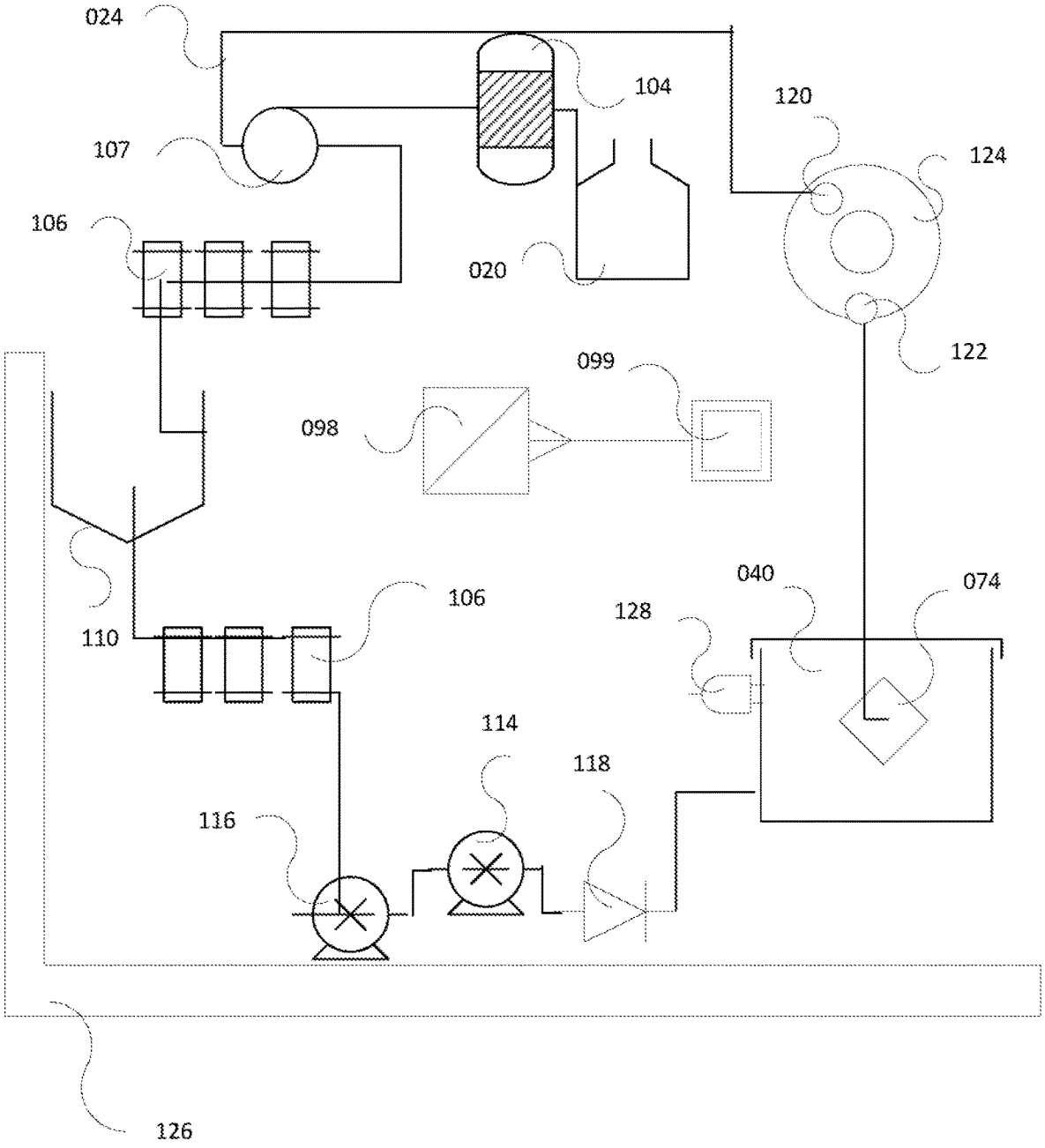
FIG. 6 shows a schematic of an exemplary system with cleaning attachment and mount system.

Referring now to FIG. 6, a schematic of an exemplary system with cleaning attachment and mount system is shown. The system shown in FIG. 6 is a variation of the system shown in FIG. 5 and further comprises a Mount System 126 and a Cleaning Attachment 124. Furthermore, the exemplary embodiment in FIG. 6 also shows at least one Liquid Level Sensor 128 may be integrated fixably or removably to the Vacuum Tank 040.

The Mount System 126 may be mobile or stationary. Examples of a Mount System 126 include a pickup truck bed, a platform, a cage, a utility truck space, a train, or scaffolding. The system components may be fully or partially enclosed. The system components may be module, meaning they may be interchangeable, upgradable, and easily replaced. System components may be removed, and the system will still function.

The Cleaning Attachment 124 may have a head, nozzle, base, or other structure intended to lay flush with the surface to be cleaned. The Cleaning Attachment 124 comprises a Liquid Deposition Outlet 120 whereby liquid from the system that enters the Cleaning Attachment 124 through a liquid conduit 024 is ejected onto the surface to be cleaned. The liquid may be water or a cleaning solution. The water or cleaning solution may or may not be pressurized and may or may not be heated. In some embodiments, steam may be produced. Exemplary cleaning solutions may include enzymes, ammonia, bleach, detergents, or surfactants. A Liquid Vacuum Inlet 122 may be present on the Cleaning Attachment 124 which facilitates the suction of the deposited liquid from the surface. The suctioned liquid is recycled and processed through the system for substantially immediate reapplication.

In some embodiments, the Circulating Pump System 102 may comprise a Control Valve 118. The Control Valve 118 may be any valve such as a ball, swing, gate, or diaphragm valve. The Control Valve 118 may be electrically or electronically controlled. The Control Valve 118 may be couple to a sensor. The Control Valve 118 regulates the flow of liquid between the Vacuum tank 040 and the Circulating Pump System 102 and the remainder of the system such as a Filtration System 106 and a Filtration Tank 110.

The system components facilitate the recycling and movement of liquid via Liquid Conduits 024 through phases of heating, pressurizing, vacuuming, and filtering. The system may be a closed loop system where the liquid is pressurized throughout the entire system, or the system may be an open loop system where the liquid is pressurized in only some phases. In some embodiments, the liquid may or may not be heated and may or may not be pressurized.

A number of embodiments of the present disclosure have been described. While this specification contains many specific implementation details, these should not be construed as limitations on the scope of any disclosures or of what may be claimed but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results.

Thus, particular embodiments of the subject matter have been described. Other embodiments are within the scope of the following claims. In some cases, the actions recited in the claims can be performed in a different order and still achieve desirable results. Nevertheless, it will be understood that various modifications may be made without departing from the spirit and scope of the claimed disclosure.

What is claimed is:

1. A multiphase cleaning system, the system comprising:
- a power supply system,
- a water source,
- a boiler system,
- a circulating pump system comprising a balancing pump having at least one liquid level sensor,
- a pressure pump system,
- a filtration system,
- a vacuum system,
- a liquid conduit,
- a filtration tank, and
- a vacuum tank,
- wherein the balancing pump is capable of moving a volume of liquid per minute into the vacuum tank substantially equal to a volume of liquid per minute flowing from the water source.

2. The system of claim 1 wherein the circulating pump system comprises the balancing pump fixably or removably connected by a liquid conduit to the vacuum tank and to a supply pump and vacuum pump-out, and wherein the supply pump is connected by a liquid conduit to the filtration tank, and wherein the vacuum pump-out is fixably or removably attached by a liquid conduit to the filtration tank and to the vacuum tank.

3. The system of claim 1 wherein the circulating pump system comprises a supply pump, a vacuum pump-out, and a control valve, wherein the control valve in connection with the at least one liquid level sensor regulates the flow of a volume of liquid into the vacuum tank.

4. The system of claim 1 wherein the filtration tank comprises an initial chamber, a final chamber, and at least one central chamber for facilitating macro filtering wherein waste material from the liquid is settled at the bottom of the plurality of filtration chambers, and the liquid exits the final chamber and enters the filtration system, and exits the filtration system, and recycles to the boiler system, and to the pressure pump system, and to a cleaning attachment.

5. The system according to claim 1 wherein the vacuum tank further comprises a low liquid level sensor, a mid liquid level sensor, and a high liquid level sensor.

* * * * *